239-585
10/22/85 OR 4,548,361 SR

United States Patent [19]

Paschke

[11] Patent Number: 4,548,361

[45] Date of Patent: Oct. 22, 1985

[54] FUEL INJECTION VALVE

[75] Inventor: Werner Paschke, Schwieberdingen, Fed. Rep. of Germany

[73] Assignee: Robert Bosch GmbH, Stuttgart, Fed. Rep. of Germany

[21] Appl. No.: 548,185

[22] Filed: Nov. 2, 1983

[30] Foreign Application Priority Data

Jan. 8, 1983 [DE] Fed. Rep. of Germany ..... 3300511

[51] Int. Cl.[4] ..... F23D 13/28; B05B 15/02; B05B 1/30

[52] U.S. Cl. ..... 239/585; 239/106

[58] Field of Search ..... 239/533.1-533.12, 239/585, 104, 106, 110, 112

[56] References Cited

U.S. PATENT DOCUMENTS

| | | | |
|---|---|---|---|
| 3,731,880 | 5/1973 | Williams | 239/585 |
| 4,356,978 | 11/1982 | Krauss | 239/533.12 |
| 4,423,841 | 1/1984 | Palma | 239/585 |
| 4,455,982 | 6/1984 | Hafner et al. | 239/533.2 X |

FOREIGN PATENT DOCUMENTS

| | | | |
|---|---|---|---|
| 2746899 | 4/1979 | Fed. Rep. of Germany | 239/112 |
| 639330 | 5/1962 | Italy | 239/533.7 |

*Primary Examiner*—Andres Kashnikow
*Assistant Examiner*—Kevin Patrick Weldon
*Attorney, Agent, or Firm*—Edwin E. Greigg

[57] ABSTRACT

A fuel injection valve which serves to inject fuel into the intake tube of internal combustion engines. The fuel injection valve includes a valve seat disposed in a valve housing, downstream of which valve seat a preparation bore is provided in a nozzle body, which terminates in the fuel flow direction at a sharp-edged nozzle body end embodied by a first conical zone. The first conical zone protrudes into a cylindrical guide conduit of a front attachment. The cylindrical guide conduit discharges via a first guide conduit end into a conically widening guide conduit, which leads via a second guide conduit end into the intake tube of an internal combustion engine.

1 Claim, 1 Drawing Figure

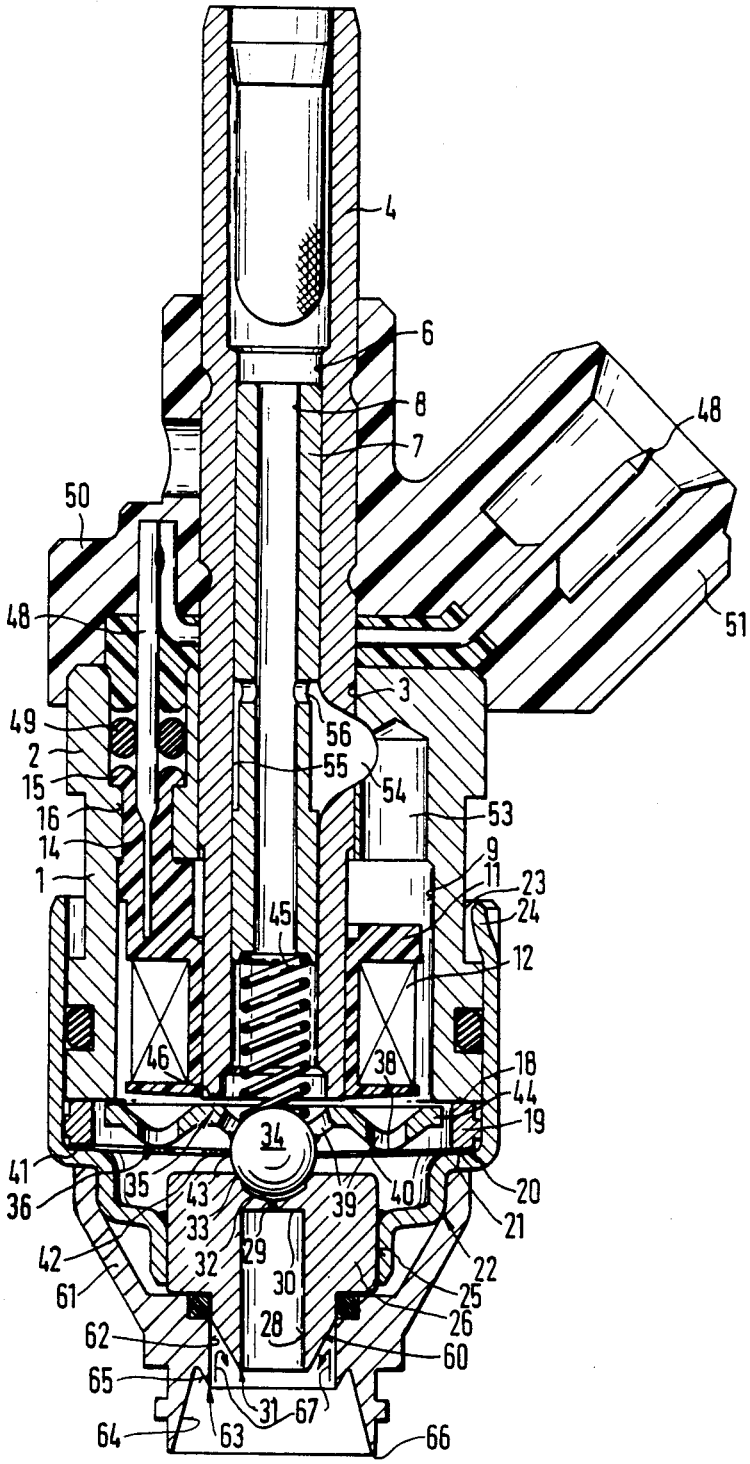
4
6
8
7
48
50
48
51
3
49
56
2
55
15
54
16
53
14
9
1
11
23
24
45
12
46
38
18
44
19
34
41
35
43
39
40
20
36
33
21
42
32
29
30
22
61
25
26
62
28
60
65
31
67
64
63
66

FUEL INJECTION VALVE

BACKGROUND OF THE INVENTION

The invention is based on a fuel injection valve for an internal injection engine.

A fuel injection valve has already been proposed in which the fuel which is to be injected is injected downstream of a valve seat into a guide conduit via a preparation bore. A small portion of the fuel quantity emerging from the preparation bore spreads out at a relatively wide angle from the main injection stream and reaches the wall of the guide conduit; there, forming relatively small droplets, it flows downward and thus drips or flows into the intake tube of internal combustion engines drop by drop. The result is a nonuniform fuel supply, causing rough engine operation.

OBJECT AND SUMMARY OF THE INVENTION

The fuel injection valve according to the invention has the advantage over the prior art in that the entry into the intake of internal combustion engines of fuel droplets forming on the guide conduit is avoided, and the supply of fuel to the intake tube is effected only by way of the main fuel stream, in the form of a mist.

The invention will be better understood and further objects and advantages thereof will become more apparent fom the ensuing detailed description of a preferred embodiment taken in conjunction with the drawing.

BRIEF DESCRIPTION OF THE DRAWING

The single FIGURE of the drawing, in simplified form, shows an exemplary embodiment of a fuel injection valve according to the invention.

DESCRIPTION OF THE PREFERRED EMBODIMENT

The fuel injection valve shown in the drawing as an example of a valve for a fuel injection system serves by way of example to inject fuel into the intake tube of mixture-compressing internal combustion engines with externally supplied ignition. A valve housing 1 fabricated by some chip-free shaping process such as deep-drawing, rolling or the like, is cup-shaped in form and has a bottom 2. A fuel fitting 4 embodied as a connection fitting is sealingly inserted into a holder bore 3 of the bottom 2. The fuel fitting 4 is made of ferromagnetic material and simultaneously acts as the inner core of an electromagnetically actuated valve. The fuel fitting 4, extending concentrically with the valve axis, has an inner bore 6, into which an adjusting sheath 7 having a through bore 8 is fitted. The end of the fuel fitting 4 protruding out of the valve housing 1 communicates with a fuel source, such as a fuel distributor line. The other end of the fuel fitting 4 protrudes into an interior chamber 9 of the valve housing and carries an insulating carrier body 11, which at least partially encompasses a magnetic coil 12. The carrier body 11 and the magnetic coil 12 do not completely fill the interior chamber 9; instead, they are supported on the fuel fitting such that there is clearance between them and the wall of the interior chamber 9; they are axially supported in a fastening bore 16 of the bottom 2 via at least one guide tang 14 by riveting or a snap-in connection 15. A spacer ring 19 rests on the end face 18 of the valve housing 1 remote from the bottom 2, and the spacer ring 19 is adjoined by a guide diaphragm 20. The other side of the guide diaphragm 20 is engaged by a collar 21 of a nozzle carrier 22, which partially surrounds and engages the valve housing 1 and is crimped into a holder groove 23 of the valve housing 1 with its end 24, so that as a result an axial tensioning force is exerted for positionally fixing the spacer ring 19 and the guide diaphragm 20. Remote from the valve housing 1, the nozzle carrier 22 has a coaxial receiving bore 25, in which a nozzle body 26 is inserted and secured, for instance by welding or soldering. The nozzle body 26 has a preferably cylindrically embodied preparation bore 28 in the form of a blind bore, and at least one fuel guide bore 29 serving to meter fuel discharges at the bore bottom 30 of the preparation bore 29. The fuel guide bore 29 preferably discharges at the bore bottom 30 of the preparation bore 28 in such a manner that a tangential flow of fuel into the preparation bore 28 will not occur; instead, the fuel stream emerges from the fuel guide bores 29 such that at first it does not contact the wall but then subsequently strikes against the wall of the preparation bore 28, from which, being distributed in an approximately parabolic film over the surface of the preparation bore 28, the fuel flows to the nozzle body end 31 and is torn off there. The fuel guide bores 29 extend at an inclination relative to the valve axis and begin at a spherical chamber 32 embodied in the nozzle body 26; a curved valve seat 33, with which a spherically embodied valve element 34 cooperates, is formed in the nozzle body 26 downstream of the spherical chamber 32. to attain the smallest possible clearance space, the volume of the spherical chamber should be as small as possible when the valve element 34 is resting on the valve seat 33.

The valve element 34 is connected with a flat armature 34, for instance by soldering or welding. The flat armature 35 may be embodied as a die-cut or molded part, and by way of example it may have an annular guide ring 36, which has a raised embodiment and rests on an annular guide area 38 of the guide diaphragm 20 on the side of the guide diaphragm 20 remote from the valve seat 33. Flowthrough openings 39 in the flat armature 35 and flow recesses 40 in the guide diaphragm 20 permit an unhindered fuel flow around the flat armature 35 and the guide diaphragm 20. The guide diaphragm 20, which is fastened to the housing between the spacer ring 19 and the collar 21 at a fastening zone 41 on its outer circumference, has a centering zone 42, which surrounds a centering opening 43, through which the movable valve element 34 protrudes and is thereby centered in the radial direction. The fastening of the guide diaphragm 20 to the housing between the spacer ring 19 and the collar 21 is effected in a plane which when the valve element 34 is resting on the valve seat 33 passes through or as close as possible to the center of the spherically embodied valve element 34. By means of the guide zone 38 of the guide diaphragm 20 engaging the guide ring 36 of the flat armature 35, the flat armature 35 is guided as parallel as possible to the end face 18 of the valve housing 1, beyond wich the flat armature 35 partially protrudes with an outer operational zone 44. A compression spring 45 is guided in the inner bore 6 of the guide fitting 4 extending almost to the flat armature 35 and engages the valve element 34 at one end and the adjusting sheath 7 on the other; it tends to urge the valve element 34 toward the valve seat 33. The fuel fitting 4 acting as the inner core is advantageously inserted into the valve housing 1 to such an extent that a small air gap still exists between its end face 46 oriented toward the flat armature 35 and the flat armature 35. When the magnetic coil 12 is in the excited state, the flat armature 35 comes to rest with its outer operational zone 44 against the end face 18 of the valve housing 1, while if the magnetic coil 12 is not excited the flat armature 35 assumes a position in which an air gap is again formed between the end face 18 and the operative zone 44. As a result, the flat armature is prevented from sticking to the inner core. After the required air gap has been established, the fuel fitting 4 is advantageously soldered or welded to the housing bottom 2. The magnetic circuit extends outside via the valve housing 1 and inside via the fuel fitting 4 and is closed via the flat armature 35.

The supply of electric current to the magnetic coil 12 is effected via contact lugs 48, which are injected partway into the carrier body 11 made of plastic and in the other end protrude out of the housing 1 beyond the fastening bores 16 in the bottom 2. The contact legs 48 may extend at an angle to the valve axis, as shown. The contact lugs 48, which are partially enveloped by the guide tangs 14 of the carrier body 11, are provided with sealing rings 49 to effect sealing in the fastening bore 16 and are spray-coated with a plastic jacket 50 which at least partially envelops the fuel fitting 4 and the bottom 2 as well. In the vicinity of the ends of the contact lugs 48, the plastic jacket 50 is molded to form a plug connection 51.

When the magnetic coil 12 is experiencing a flow of electric current through it and when the flat armature 35 is thus attracted, the fuel flowing via the fuel fitting 4 can be partially metered at the fuel guide bores 29 and ejected via the preparation bore 28. Especially following a shutoff of the engine, the danger exists that because of the heat transferred from the engine to the injection valves fuel in the valves and fuel lines will vaporize, which can cause problems the next time the engine is started. Thus a blind bore 53 open toward the interior chamber 9 of the valve housing 1 is provided on the bottom 2 of the valve housing 1, and vapor bubbles can collect in this blind bore 53 and then pass via a connecting section 54 to an annular groove 55 embodied between the adjusting sheath 7 and the fuel fitting 4, for instance in the surface of the adjusting sheath 7. From the annular groove 55, degassing openings 56 extend approximately radially into the through bore 8 of the adjusting sheath 7. The blind bore 53, connecting section 54, annular groove 55 and degassing openings 56 thus together form a venting line, by way of which vapor bubbles can escape out of the valve housing 1 into the fuel fitting 4 at a sufficient distance away from the valve seat 33. The connecting section 54, which is embodied in the fuel fitting 4 and partially in the bottom 2, is advantageously produced by a known electroerosive material-removing process, following which the fuel fitting 4 will have been fixed in place in the bottom 2 of the valve housing 1.

In order to attain a main fuel stream which is ejected in as fine a mist as possible, the nozzle body end 31 is embodied with sharp edges. To this end, a first conical zone 60 is formed on the nozzle body 26, extending such that beginning at the circumference of the nozzle body 26 it tapers toward the nozzle body end 31. To attain a sharp nozzle body end 31, the walls of the preparation bore 28 and of the first conical zone 60 should form an acute angle with one another. A front attachment 61 is placed over the nozzle body 26; it may also partially encompass and grip the nozzle carrier 22 and is secured thereon. To effect thermal insulation, the front attachment 61 may be made of some material such as plastic which is a poor heat conductor. The nozzle body end 31 protrudes into a cylindrical guide conduit 62 embodied in the front attachment 61 and discharging via a first guide conduit end 63, likewise embodied with sharp edges, into a conically widening guide conduit 64 embodied with a larger cross section. From the conically widening guide conduit 64 to the first guide conduit end 63, a second conical zone 65 is formed which tapers toward the cylindrical guide conduit 62. The conically widening guide conduit 64 terminates at a sharp-edged second guide conduit end 66. During a fuel injection, the film-like fuel stream rips off at the nozzle body end 31 and then, via the cylindrical guide conduit 62 and the conically widening guide conduit 64, enters the intake tube of the engine, for instance. From this main fuel stream ripping off at the nozzle body end 31, particles of fuel spread out toward the wall of the cylindrical guide conduit 62 and flow downward on this wall toward the first guide conduit end 63, where an annular bulge of fuel forms, and because of surface tension as well the wall of the cylindrical guide conduit 62 remains moistened with fuel. During the injection event, an upward flow of air forms between the nozzle body end 31 and the wall of the cylindrical guide conduit 62 as indicated by the arrows 67, which carries the fuel adhering there upward with it and back via the surface of the first conical zone 60 to the nozzle body end 31, where this fuel is then taken up by the main fuel stream emerging from the preparation bore 28 and is then, being finely prepared, injected along with this main fuel stream.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection valve including a nozzle body which extends into a front attachment a valve seat in said nozzle body, a preparation bore in said nozzle body which terminates at a sharp-edged nozzle body end in a direction of fuel flow, a first conical zone tapering from the circumference of said nozzle body toward the preparation bore at the nozzle body end, a cylindrical guide conduit in said front attachment, a first conical zone of the nozzle body protrudes into said cylindrical guide conduit, said cylindrical guide conduit including a sharp-edged first guide conduit end which is located at a second conical zone in said front attachment which tapers toward said cylindrical guide conduit and discharges into a guide conduit in said front attachment embodied with a larger cross section with an increasing diameter which widens in conical fashion, and said guide conduit leads to a sharp-edged second guide conduit end.

* * * * *